US006988355B2

(12) United States Patent
Stahlecker et al.

(10) Patent No.: US 6,988,355 B2
(45) Date of Patent: Jan. 24, 2006

(54) DOUBLE-APRON DRAFTING UNIT FOR SPINNING MACHINES

(75) Inventors: Gerd Stahlecker, Eislingen/Fils (DE); Nikolaus Schoch, Waeschenbeuren (DE)

(73) Assignee: Maschinenfabrik Rieter AG, Winterthur (CH)

( * ) Notice: Subject to any disclaimer, the term of this patent is extended or adjusted under 35 U.S.C. 154(b) by 0 days.

(21) Appl. No.: 10/816,207

(22) Filed: Apr. 2, 2004

(65) Prior Publication Data

US 2004/0244150 A1 Dec. 9, 2004

(30) Foreign Application Priority Data

Apr. 2, 2003 (DE) ..... 103 15 933

(51) Int. Cl.
*D01H 5/86* (2006.01)

(52) U.S. Cl. ..... 57/315; 19/244

(58) Field of Classification Search ..... 57/315–333; 19/105, 107, 112, 150, 157, 244–256
See application file for complete search history.

(56) References Cited

U.S. PATENT DOCUMENTS 3,727,391 A 4/1973 Hiserman et al.
3,742,696 A * 7/1973 Hedaway ..... 57/331
4,107,911 A * 8/1978 Yamana et al. ..... 57/304
5,335,397 A * 8/1994 Stahlecker ..... 19/255
5,465,465 A * 11/1995 Stahlecker ..... 19/292

FOREIGN PATENT DOCUMENTS

| | | |
|---|---|---|
| DE | 3039 149 | 5/1981 |
| DE | 39 31 462 | 4/1990 |
| DE | 40 03 019 | 8/1991 |
| DE | 41 32 919 A1 | 4/1993 |
| EP | 107 828 | 5/1984 |
| JP | 60 151321 A | 8/1985 |
| JP | 62-15649 | 8/1994 |

* cited by examiner

*Primary Examiner*—John J. Calvert
*Assistant Examiner*—Shaun R Hurley
(74) *Attorney, Agent, or Firm*—Crowell & Moring LLP

(57) ABSTRACT

A double-apron drafting unit for spinning machines has a delivery roller pair and an apron pair arranged upstream therefrom. The apron pair guides a fiber strand in the area of a delivery nipping line, with which it forms a wedge-shaped gap. Devices are provided for keeping air currents, which circulate with the delivery roller pair, away from the area of the delivery nipping line, which devices are located outside of the wedge-shaped gap point formed by the delivery nipping line and the apron pair. The devices are, however, located in direct proximity to the delivery roller pair and the apron pair.

21 Claims, 5 Drawing Sheets

DOUBLE-APRON DRAFTING UNIT FOR SPINNING MACHINES

BACKGROUND AND SUMMARY OF THE INVENTION

This application claims the priority of German Application No. 103 15 933.9 filed Apr. 2, 2003, the disclosure of which is expressly incorporated by reference herein.

The present invention relates to a double-apron drafting unit for spinning machines, comprising a delivery roller pair having a delivery nipping line, also comprising an apron pair, arranged upstream thereof and guiding a fiber strand in the area of the delivery nipping line, and forming together with the delivery roller pair a wedge-shaped gap, as well as means for keeping air currents circulating with the delivery roller pair away from the area of the delivery nipping line.

In the case of such double-apron drafting units, in particular when they are applied to so-called air jet spinning, delivery speeds can be reached by which the air currents, caused by the rotating delivery rollers, cannot be ignored. Due to their high rotational speeds, the rotating rollers pull in air which circulates with the rollers. The air currents are cut off in delivery direction of the delivery rollers at the delivery nipping line. Air is transported continuously into the wedge-shaped gap between the apron pair and the delivery nipping line of the two rollers. This air escapes on the one hand out of the wedge-shaped gap in axial direction on both sides, while on the other hand, it flows in the opposite direction to the transport direction of the fiber strand. This results in air vortexes and to disruption in the fiber flow. The air flow causes a certain amount of disruption among the fibers of the fiber strand which exits from the apron pair and travels towards the delivery nipping line. This is demonstrated, for example, by an exponential decrease in the yarn quality values with the increase in the delivery speed.

The as a rule grooved bottom roller of the delivery roller pair exerts a great influence on the negative air currents flowing into the wedge-shaped gap. The undesirable air currents were reduced somewhat, in that the friction coefficient of the bottom roller was increased, not by fluting, but by application of a corresponding surface coating. Independently of the fact that the fluting method has asserted itself in the industry, a surface coating only would not suffice to prevent the pulling in and circulation of air currents at high delivery speeds.

Many efforts have been made to eliminate the disadvantages described above, or least to reduce their effects. In German published patent application 30 39 149 C2 (corresponding U.S. Pat. No. 4,387,487), for example, it is suggested that the exit area of the apron pair, in relation to the delivery nipping line of the delivery roller pair, be placed in a direction diagonal to the traveling path of the fiber strand. The idea was that by means of this misalignment, the fiber path could avoid the above mentioned air currents, thus subsequently being able to reach the delivery nipping line in an area in close proximity to the surface of the nearest roller of the delivery roller pair. These measures were, however, doomed to failure because, of course, the air currents rotating with the delivery roller pair are interrupted at the delivery nipping line and lead in any case to air vortexes.

In German published patent application 39 31 462, another suggestion was put forward in an attempt to lessen the above mentioned disadvantages in that circulating grooves acting as passageways for a throughput of air were applied to the top roller of the delivery roller pair adjacent to the fiber strand. This was to ensure that those fibers, which tended to yield laterally, were drawn together again. This measure could not, however, be put into practice, as a traversing of the fiber strand, required for such an embodiment for protecting the top roller against wear, was not possible.

An embodiment according to European published patent 0 107 828 (corresponding U.S. Pat. No. 4,520,532) attempted to place the apron pair extremely close to—almost in contact with—the delivery roller pair downstream. The apron pair was to function as a screen against the undesirable air currents. It was, however, shown that in practice, a gap measuring less than 0.2 mm was not possible. Boundary layers of the above mentioned air currents have, however, heights which measure less than 0.2 mm, so that the desired aim could only be partly achieved. This measure results, however, in the advantage that the fiber strand is guideless for only a very short way between the apron pair and the delivery nipping line, which produces a noticeable improvement in the yarn quality values.

Furthermore, further suggestions have been made in which the air currents rotating with the delivery roller pair are screened off.

According to the Japanese published patent 62-15649, an attempt is made to encase the delivery roller pair in the area of the wedge-shaped gap between the apron pair and the delivery roller pair. For this purpose thin metal plates are provided, whose contours match those of the delivery rollers and which are deposited in a flexible way in the area of the delivery nipping line on the rollers. These plates have a slight gap, through which the fiber strand is guided. The disadvantage of this embodiment was simply that these screens were located in the wedge-shaped gap area between the apron pair and the delivery nipping line, so that the apron pair must end at a clear distance upstream of the delivery nipping line, which leads to an extended path without guidance for the fibers of the fiber strand.

A similar measure was attempted in U.S. Pat. No. 3,727,391, whereby freely supported "riders" were placed on the rollers in the wedge-shaped gap between the apron pair and the delivery nipping line, which "riders" surrounded, wing-like, the periphery of both rollers of the delivery roller pair over a certain distance. A slit was located in the centre for guiding the fiber strand through. The disadvantage here is also that the apron pair must end at a clear distance upstream of the delivery nipping line.

Finally, in German published patent application 40 03 019, it is known that the rollers of the bottom roller pair are covered over a large extent of their periphery by semispherical covers disposed thereon in a gliding manner. There is also an opening here for guiding the fiber strand through. This measure does indeed destroy the boundary layers of the undesirable air currents, but the above mentioned disadvantage exists here also in that the apron pair must end at a relatively large distance upstream of the delivery roller pair.

It is an object of the present invention in the case of a double-apron drafting unit of the above mentioned type to keep the undesirable air currents away from the delivery nipping line as effectively as possible, without preventing the apron pair being placed as near as possible to the delivery roller pair.

This object has been achieved in accordance with the present invention in that the means for keeping away the air currents circulating with the delivery roller pair are arranged outside of the wedge-shaped gap formed by the delivery nipping line and the apron pair, but in direct proximity to the delivery roller pair and the apron pair.

With the application of the features of the present invention, it is possible to keep the impairing air currents away from the delivery nipping line without hindering the guiding of the fibers between the apron pair and the delivery nipping line. It is ensured, however, in using the above mentioned measures that the means are not too far away from the delivery nipping line, so that obstructed air currents do not have the chance to form again. It has been shown to be practicable when the means for keeping away the circulating air currents are disposed in a peripheral area of approximately 30° to 60° of the rollers of the delivery roller pair, measured respectively from the delivery nipping line.

Using advantageous measures it can now be attempted to provide means for interrupting the boundary layers of the air currents on at least one roller of the delivery roller pair. Such a measure on the bottom roller of the delivery roller pair is, as explained above, particularly important. The boundary layer of the air currents can then be interrupted when the means are placed nearer than 0.2 mm to the respective roller.

The features according to the present invention can be realized in practice in many varying ways.

In one embodiment it is provided that the means are at a preferably adjustable distance in relation to the periphery of the arranged roller. These means could be, for example, a covering comprising a sealing gap which can be reduced down to 0.1 mm if required. The undesirable air currents diminish with increased reduction of the radial sealing gap.

In another embodiment it can be provided that the means come into contact with the periphery of the arranged roller. This naturally gives the most effective results, as the boundary layer of the air currents are most definitely destroyed. A lip touching the arranged roller or a flexibly arranged shoulder can be advantageously involved in this case. Such means could also comprise a slowly rotating roller, which is provided with pockets on its circumference, with which pockets waste fibers could be collected. Because of the slow rotation of the roller, the pockets can be emptied from time to time or be continuously suctioned. The means may alternatively comprise a brush, which is placed at the respective roller. A fine-bristle, contact brush is especially suitable for the top roller of the delivery roller pair.

It has been shown that means having contact with the delivery roller pair can interrupt the boundary layer of the undesirable air currents most effectively, however, this measure has on the other hand the disadvantage in that rotating fibers may also be nipped. For this reason, it is advantageous in a further embodiment of the present invention when the above mentioned means comprise a suction device. Such a suction device, which may be applied on its own for destroying the boundary layers of the circulating air currents, can be applied to all above mentioned variations. A device having contact with the circumferential surface of the delivery roller pair and having a suction device arranged thereto has proven itself to be particularly effective. A suction roller may be provided in this case as a suction device.

These and further objects, features and advantages of the present invention will become more readily apparent from the following detailed description thereof when taken in conjunction with the accompanying drawings.

DETAILED DESCRIPTION OF THE DRAWINGS

Figure 1:
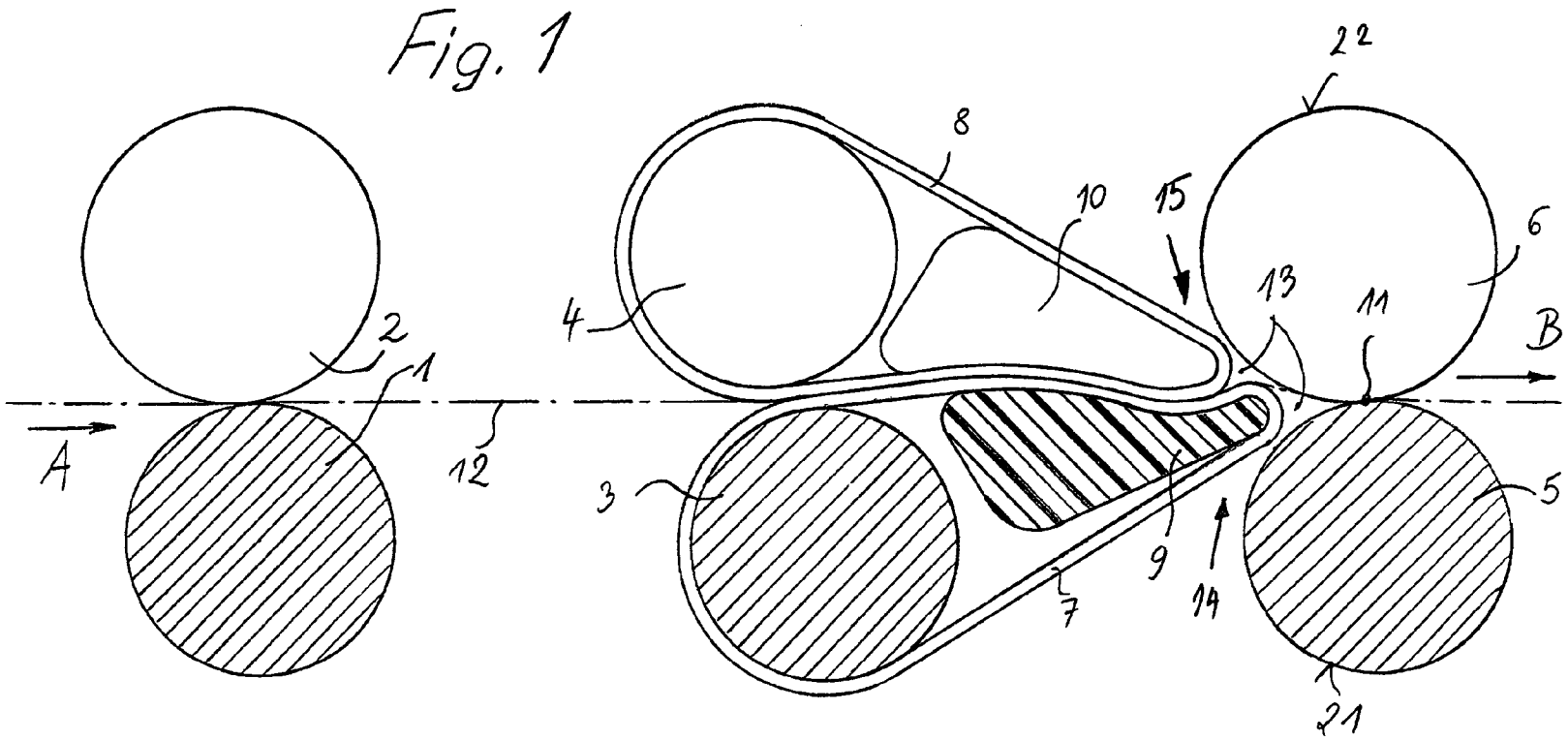
FIG. 1 is a partly sectional enlarged side view of a double-apron drafting unit in which the devices for keeping away undesirable air currents according to the present invention are not yet shown, as only the principal problem is explained.

The double-apron drafting unit for spinning machines shown in FIG. 1 takes the form of a three-cylinder drafting unit and comprises a feed roller pair 1,2, an apron roller pair 3,4 as well as a delivery roller pair 5,6. In the case of the rollers 1,3 and 5, driven bottom rollers are involved, and in the case of the rollers 2,4 and 6, they are respective flexible pressure rollers disposed on the driven bottom rollers. The apron roller pair 3,4 is looped by an apron pair 7,8, whereby the apron 7 is a lower apron and the apron 8 is an upper apron. The number 9 denotes a guiding device for the lower apron 7, while 10 denotes a guiding device for the upper apron 8.

The delivery roller pair 5,6 defines a delivery nipping line 11, on which the draft of the fiber strand 12 to be drafted, denoted by a dot-dash line, comes to an end. The fiber strand 12 is fed in feed direction A to the double-apron drafting unit and is subsequently fed downstream of the delivery nipping line 11 in delivery direction B to a twist device (not shown).

It has been established that when the apron pair 7,8 is guided as close as possible to the periphery 21 or 22 of the respective roller 5,6, this has a favorable effect on the quality of the yarn. This does not necessarily result in the air currents circulating with the delivery roller pair 5,6 being interrupted, but it does, however, lead to the path of the fiber strand 12 from its exit out of the apron pair 7,8 to the periphery 21 or 22 of a roller 5,6 being so significantly shortened that, upstream of the delivery nipping line 11, the fiber strand 12 is without guidance for a very short distance only. This is very important for the subsequent yarn quality.

As described above, it is very inconvenient when the air currents circulating with the delivery roller pair 5,6 are interrupted at the delivery nipping line 11, which then leads to air vortexes, which disturb the flow of the fiber strand 12 in this critical area. The wedge-shaped gap 13 between the apron pair 7,8 and the delivery nipping line 11 is here particularly critical, as the fiber strand 12 is already drafted to a very thin sliver, yet still without twist and thus unstable. In the area of the wedge-shaped gap 13, the air currents circulating with the rollers 5,6 must at all costs be prevented from flowing off laterally and thus driving the fiber strand 12 laterally outwards or even in the opposite direction to the transport direction A,B.

In order, on the one hand not to hinder the placing of the apron pair 7,8 to the respective periphery 21,22 of the roller pair 5,6 and, on the other hand, to prevent the undesirable air currents, it is provided according to the present invention to apply devices shown in FIG. 1 and denoted by the numbers 14 and 15, which devices are devised to keep away the circulating air currents from the area of the delivery nipping line 11. These devices may themselves already be known, whereby the novelty of the present invention lies in the fact that said devices are provided in the two feeder gaps, denoted by the numbers 14 and 15, between the lower apron 7 and the bottom roller 5 on the one hand and between the upper apron 8 and the top roller 6 on the other hand.

The following FIGS. 2 to 5 show schematically represented embodiments as to how the means according to the present invention can be advantageously applied to these feeder gaps 14 and 15, without the wedge-shaped gap 13 between the apron pair 7,8 and the delivery nipping line 11 being impaired. The means to be applied should, according to their design, destroy the boundary layer of the air currents of at least one roller 5 or 6.

Figure 2:
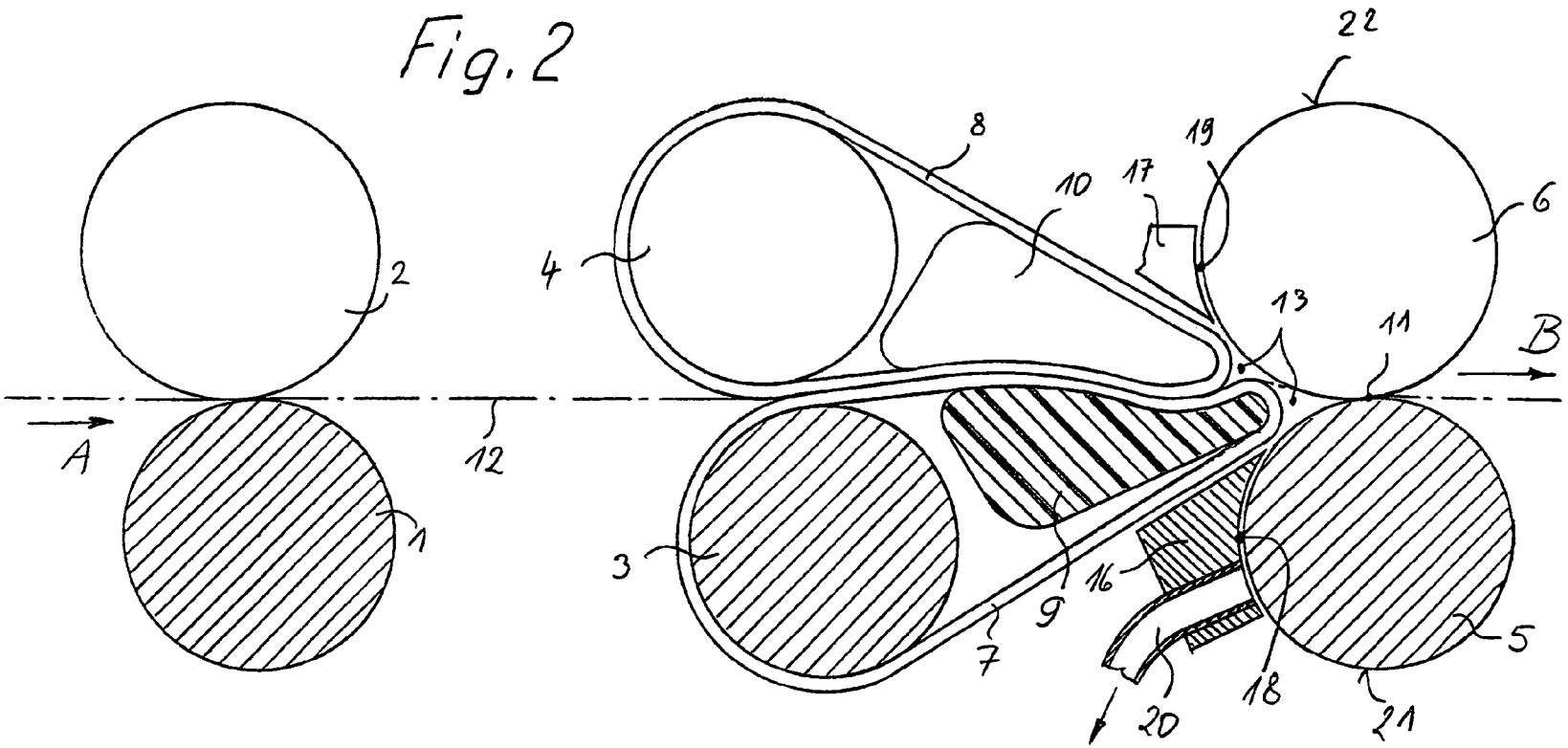
FIG. 2 shows the drafting unit shown in FIG. 1, in which means for preventing the air currents are provided and hereby have a distance to the periphery of the respective rollers, constructed in accordance with a first preferred embodiment of the present invention.

According to FIG. 2 it is provided that an air current suppressing cover 16,17 is applied to the bottom roller 5 as well as to the top roller 6 of the delivery roller pair 5,6, between which suppressing cover 16,17 and the periphery 21 or 22 of the respective roller 5,6, is a very narrow gap 18,19, which preferably measures less than 0.2 mm. These suppressing covers 16 and 17 may in addition be connected to a suction device 20, as shown for the lower suppressing cover 16. A suction device contributes on the one hand to the destruction of the boundary layers of the undesirable air currents, while on the other hand ensuring that waste fibers fed by the air currents to the delivery nipping line 11 can be immediately suctioned off.

Figure 3:
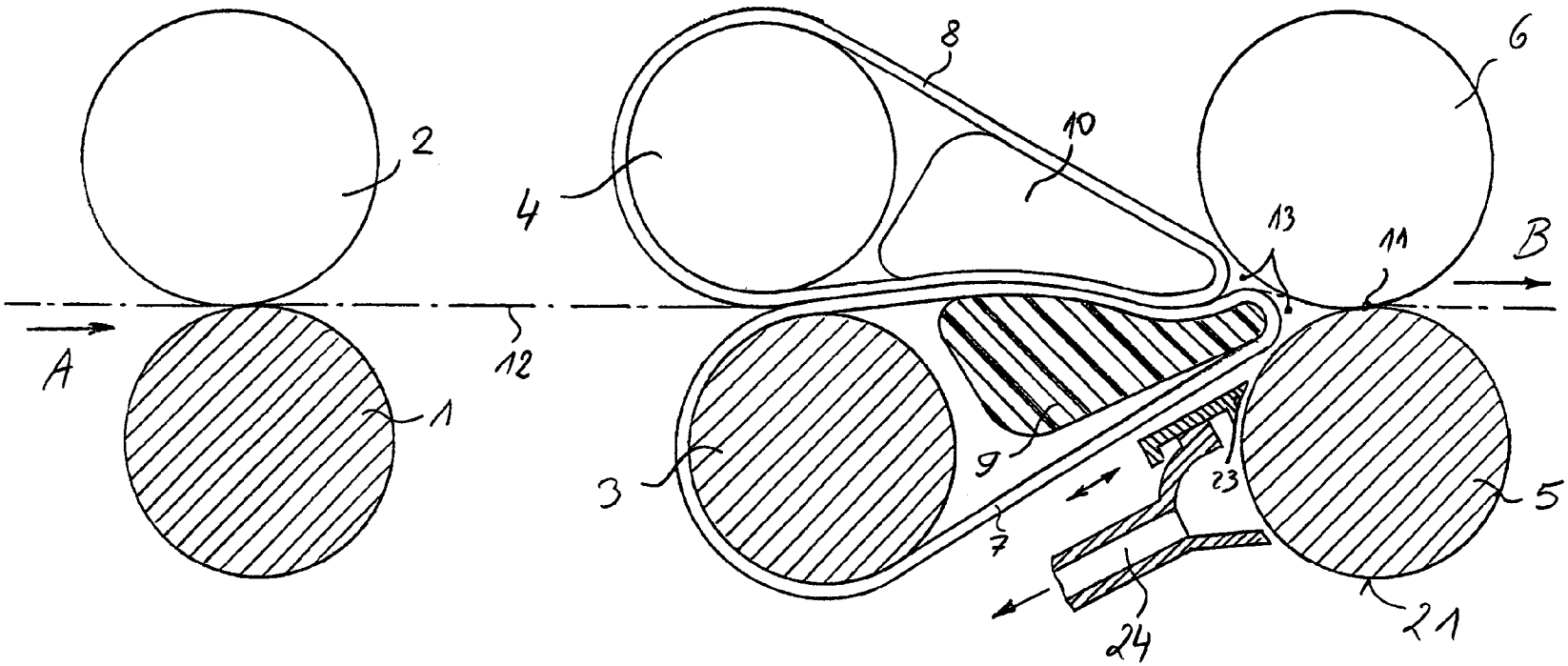
FIG. 3 shows the drafting unit shown in FIG. 1, whereby the means for preventing the air currents comprise a lip with which the distance can be adjusted, constructed in accordance with a second preferred embodiment of the present invention.

According also to FIG. 3, a non-contact device for preventing the air currents is provided at least at the bottom roller 5, whereby these devices comprise here an adjustable lip 23, which is in turn connected to a suitable suction device 24. The distance to the lip 23 can also be adjusted in relation to the circumference 21, so that the gap is significantly shorter than 0.2 mm.

Figure 4:
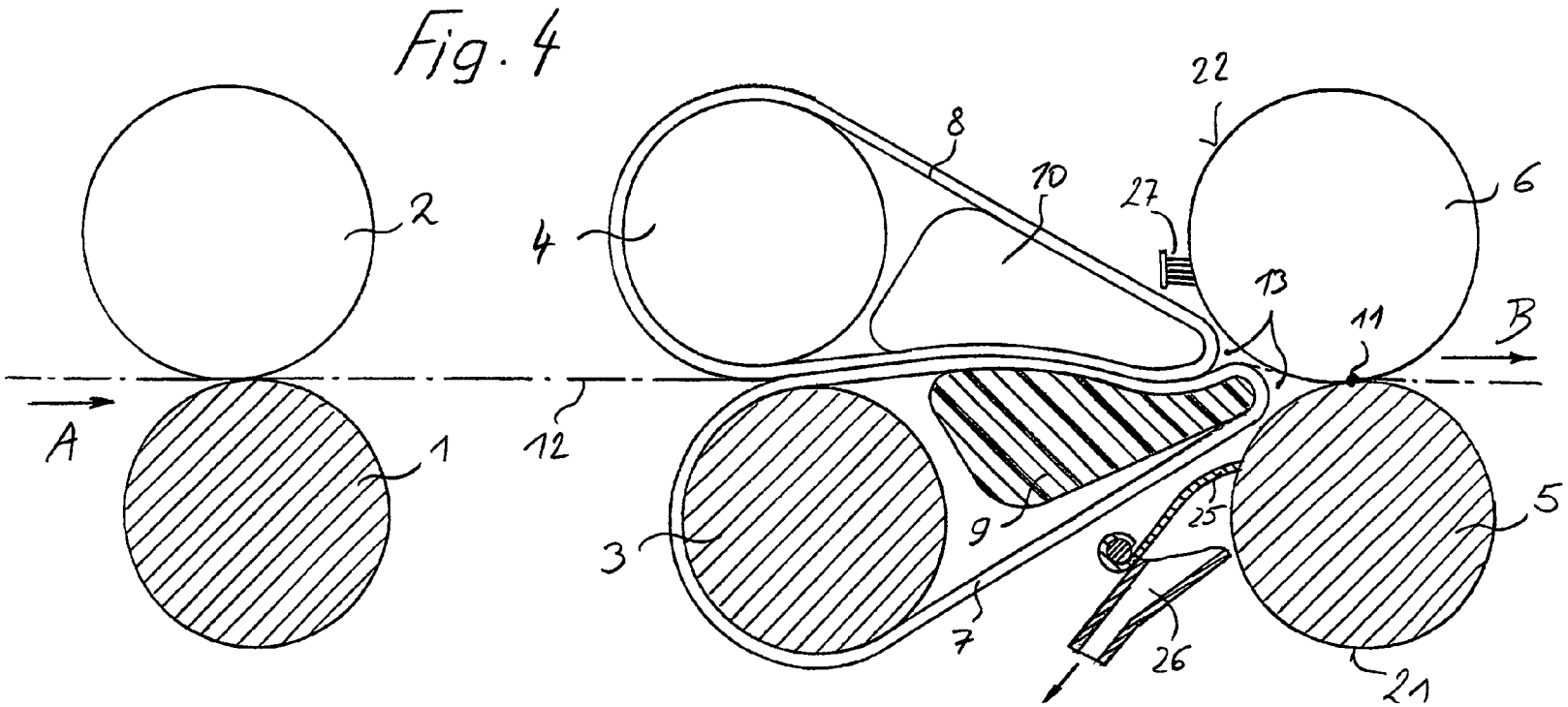
FIG. 4 shows the drafting unit shown in FIG. 1, whereby the means for preventing the air current includes means which come into contact with the periphery of the respective rollers, constructed in accordance with a third preferred embodiment of the present invention.

According to FIG. 4 it is provided, that the means for interrupting the boundary layer of the air currents circulating with the rollers 5 and 6 are disposed on their peripheries 21 and 22. In the case of the bottom roller 5, a flexible, adjustable shoulder 25 is provided, which in turn is connected to a suction device 26, in the case of the top roller 6 a brush 27 with very fine bristles is provided. Alternatively it can of course be provided that each of the above named means 25 or 27 can be applied to both rollers 5,6.

Figure 5:
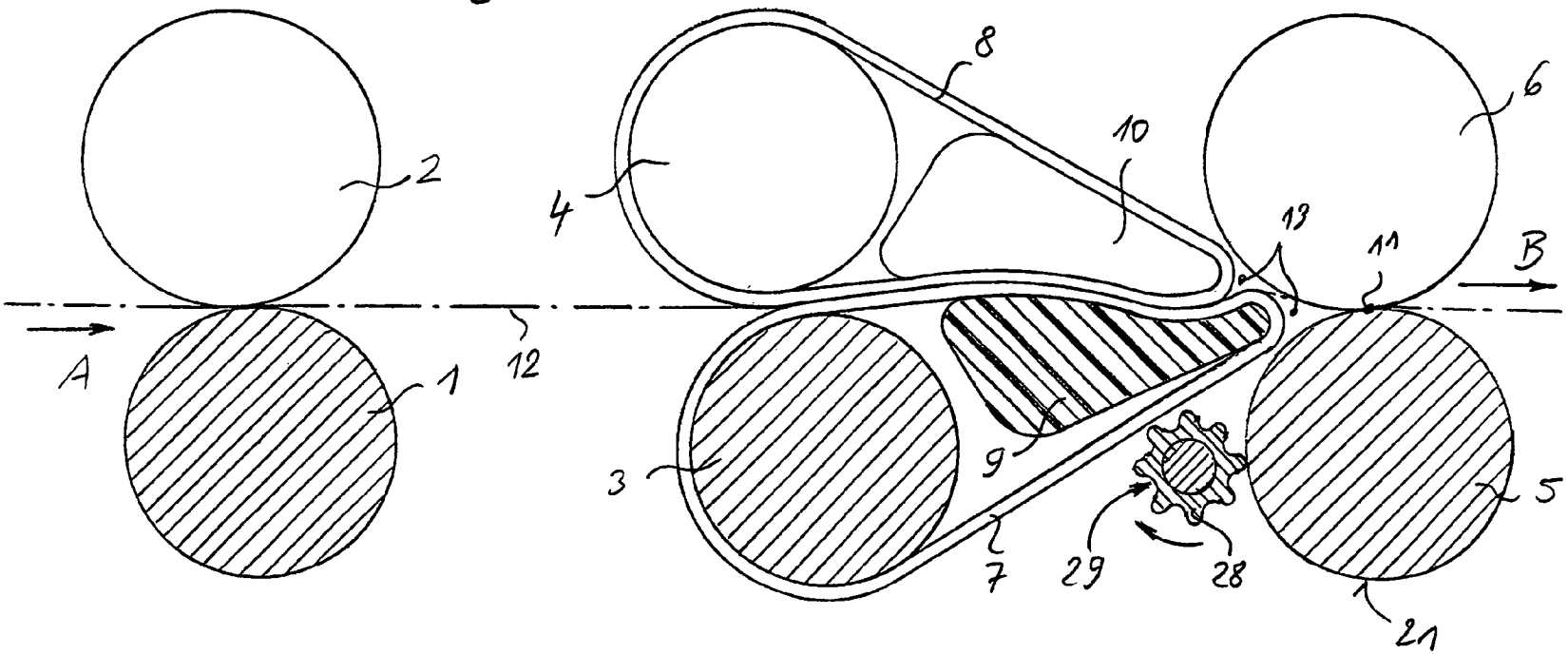
FIG. 5 shows the drafting unit shown in FIG. 1, in which the means for preventing the air currents comprise a slowly rotating roller provided with peripheral pockets, constructed in accordance with a fourth preferred embodiment of the present invention.

According to FIG. 5 a roller 28 is provided which rotates slowly in the opposite direction to the direction of motion of the bottom apron 7 and the bottom roller 5, which roller 28 is provided around its periphery with pockets 29, with which waste fibers may be removed. The roller 28, which comes into contact with the periphery 21 of the bottom roller 5, can be connected to a suction device in a way not shown.

It is expressly stated that all the above mentioned devices can, as required, be arranged at the bottom roller 5 as well as at the top roller 6 of the delivery roller pair 5,6, and that these means can be combined with one another or exchanged one for another if required. Which of the devices for the present application is the most favorable must be established by means of tests.

In all cases what is important is that the wedge-shaped gap 13, located between the apron pair 7,8 and the delivery nipping line 11 remains free from any additional means, so that the fiber strand 12 has as short a path as possible without guidance, and that all the above mentioned devices are applied in the areas denoted by the numbers 14 and 15.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations within the scope of the appended claims and equivalents thereof.

What is claimed is:

1. Double-apron drafting unit for spinning machines, comprising a delivery roller pair having a delivery nipping line, also comprising an apron pair, arranged upstream thereof and guiding a fiber strand in the area of the delivery nipping line, and forming together with said delivery roller pair a wedge-shaped gap, as well as air flow control means for keeping air currents circulating with the delivery roller pair away from the area of the delivery nipping line, wherein the air flow control means are arranged outside of the wedge-shaped gap formed by the delivery nipping line and the apron pair, but in direct proximity of the delivery roller pair and the apron pair.

2. Double-apron drafting unit according to claim 1, wherein the air flow control means include boundary layer interrupting means for interrupting a boundary layer of air currents provided at at least one roller of the delivery roller pair.

3. Double-apron drafting unit according to claim 2, wherein the boundary layer interrupting means are at a preferably adjustable distance with respect to the periphery of the respective roller.

4. Double-apron drafting unit according to claim 2, wherein the boundary layer interrupting means come into contact with the periphery of the respective rollers.

5. Double-apron drafting unit according to claim 4, wherein the boundary layer interrupting means comprise a circulating roller.

6. Double-apron drafting unit according to claim 4, wherein the boundary layer interrupting means comprise a brush or the like.

7. Double-apron drafting unit according to claim 2, wherein the boundary layer interrupting means comprise a suction device.

8. Double-apron drafting unit according to claim 3, wherein the boundary layer interrupting means comprise a suction device.

9. Double-apron drafting unit according to claim 4, wherein the boundary layer interrupting means comprise a suction device.

10. Double-apron drafting unit according to claim 5, wherein the boundary layer interrupting means comprise a suction device.

11. Double-apron drafting unit according to claim 6, wherein the boundary layer interrupting means comprise a suction device.

12. Double-apron drafting unit according to claim 2, wherein the boundary layer interrupting means are disposed in a peripheral area of between 30° and 60° of the respective rollers of the delivery roller pair.

13. Double-apron drafting unit for spinning machines, comprising:

a delivery roller pair forming a delivery nipping line, an apron pair arranged upstream of the delivery roller pair, said apron pair forming a wedge-shaped gap together with the delivery roller pair, and air flow control structure operable to keep air currents circulating with the delivery roller pair away from the delivery nipping line, said air flow control structure being disposed outside the gap in direct proximity of the delivery roller pair and the apron pair.

14. Double-apron drafting unit according to claim 13, wherein the air flow control structure comprises boundary layer interrupting structure operable to interrupt boundary layers of the air currents at at least one roller of the delivery roller pair.

15. Double-apron drafting unit according to claim 14, wherein the boundary layer interrupting structure includes a suction device which faces a respective delivery roller surface adjacent the gap.

16. Double-apron drafting unit according to claim 14, wherein the boundary layer interrupting structure includes a suppressing cover which faces a respective delivery roller surface and is spaced therefrom by less than 0.2 mm.

17. Double-apron drafting unit according to claim 16, wherein the boundary layer interrupting structure includes a suction device which faces a respective delivery roller surface adjacent the gap, said suction device being operable to suck air through the suppressing cover.

18. Double-apron drafting unit according to claim 16, wherein the suppressing cover extends over 30° to 60° of the circumference of a respective delivery roller surface.

19. Double-apron drafting unit according to claim 14, wherein the boundary layer interrupting structure engages a portion of the respective delivery roller surface.

20. Double-apron drafting unit according to claim 19, wherein the boundary layer interrupting structure includes a roller with pockets facing a portion of a respective delivery roller surface.

21. Double-apron drafting unit for spinning machines, comprising:

a delivery roller pair forming a delivery nipping line, an apron pair arranged upstream of the delivery roller pair, said apron pair forming a wedge-shaped gap together with the delivery roller pair, and air flow control means operable to keep air currents circulating with the delivery roller pair away from the delivery nipping line, said air flow control means being disposed outside the gap in direct proximity of the delivery roller pair and the apron pair.

* * * * *